United States Patent [19]

Maruyama

[11] Patent Number: 4,521,964

[45] Date of Patent: Jun. 11, 1985

[54] TOOL FOR MEALS WITH THE FUNCTION OF SCISSORS

[76] Inventor: Takashi Maruyama, 12-9, Kitakarasuyama 9-chome, Setagaya-ku, Tokyo 157, Japan

[21] Appl. No.: 486,229

[22] Filed: Apr. 18, 1983

[30] Foreign Application Priority Data

| | | | |
|---|---|---|---|
| Apr. 23, 1982 | [JP] | Japan | 57-58413[U] |
| Feb. 14, 1983 | [JP] | Japan | 58-19014[U] |
| Mar. 7, 1983 | [JP] | Japan | 58-31650[U] |

[51] Int. Cl.[3] ..... B26B 13/00

[52] U.S. Cl. ..... 30/148; 30/145; 30/149; 17/66; 17/71

[58] Field of Search ..... 30/148, 142, 131, 145, 30/146; 7/131, 112, 135, 134; 17/71, 66

[56] References Cited

U.S. PATENT DOCUMENTS

| | | | |
|---|---|---|---|
| 1,219,857 | 3/1917 | Parkhurst | 17/71 |
| 1,230,766 | 6/1917 | Ovens | 30/142 |
| 4,103,395 | 8/1978 | Latorella | 17/71 |
| 4,182,032 | 1/1980 | Newport | 30/137 |
| 4,200,961 | 5/1980 | Mueller | 17/66 |
| 4,315,369 | 2/1982 | Borow | 30/148 |

FOREIGN PATENT DOCUMENTS

| | | | |
|---|---|---|---|
| 614276 | 6/1935 | Fed. Rep. of Germany | 30/148 |
| 1989125 | 7/1968 | Fed. Rep. of Germany . | |
| 509260 | 11/1920 | France | 30/148 |
| 29-4324 | 10/1954 | Japan . | |
| 53-148080 | 11/1978 | Japan . | |
| 14268 | of 1907 | United Kingdom | 7/131 |

*Primary Examiner*—Jimmy C. Peters

*Attorney, Agent, or Firm*—Balogh, Osann, Kramer, Dvorak, Genova & Traub

[57] ABSTRACT

A fork or a spoon for meals in which although the tip portion is almost the same as the tip of a usual fork or spoon, it is longitudinally divided in two portions. An edge is set in each divided border side of said divided portions and the function of scissors is added. The handle portion of the fork or the spoon is the same as that of scissors. It is the tool for meals with the functions of other tools for meals as well as scissors.

1 Claim, 24 Drawing Figures

TOOL FOR MEALS WITH THE FUNCTION OF SCISSORS

BACKGROUND OF THE INVENTION

The present invention is about the tool for meals in which the function of scissors is added to a fork or a spoon for meals. Although knife, fork and spoon are used as tools for meals in Western countries, chopsticks are mainly used in the East. Both hands must be used at meals with knife and fork. As good skill is necessary for us to use chopsticks, the development of more simple tools for meals has been desired. According to the Japanese utility model publication No. 39175-1974 about the tool for meals with the function of fork and chopsticks, the tool has no function of cutting foods into small pieces.

SUMMARY OF THE INVENTION

It is an object of the present invention to provide a fork or a spoon with the function of scissors. The fork with the function of scissors will be explained as follows. The fork has the function of scissors with two blade bodies. Each blade body consists of the tip, the central and the handle portions. In the tip portion a fork is set diverging and separating from the back portion and in parallel with it in the back portion of one edge in two edges in the tip of said scissors. Two blade bodies form scissors combined by pin at the axis of scissors in each central portion of said two blade bodies. As each edge of said two-blade bodies overlaps the other, the tip portion is similar to the tip of a usual fork for meals. The spoon with the function of scissors will be explained as follows. The spoon has the function of scissors with two blade bodies. Each blade body has the shape of one part in which the sunken portion of the tip of a usual spoon for meals is divided in two portions. Each blade body consists of the tip portion in which an edge is set in said divided border side, the central portion and the handle portion. Two blade bodies form scissors combined by pin at the axis of scissors in each central portion of said two blade bodies. As each edge of said two-blade bodies overlaps the other, the tip portion is similar to the sunken portion of a usual spoon for meals. These and further object and advantage of this invention will become apparent from following more detailed description of an illustrative embodiment of the invention, which will now be given in conjunction with the accompanying drawings.

DESCRIPTION OF THE PREFERRED EMBODIMENT

The present invention will now be described in greater detail with reference to the illustrated embodiment.

Figure 1:
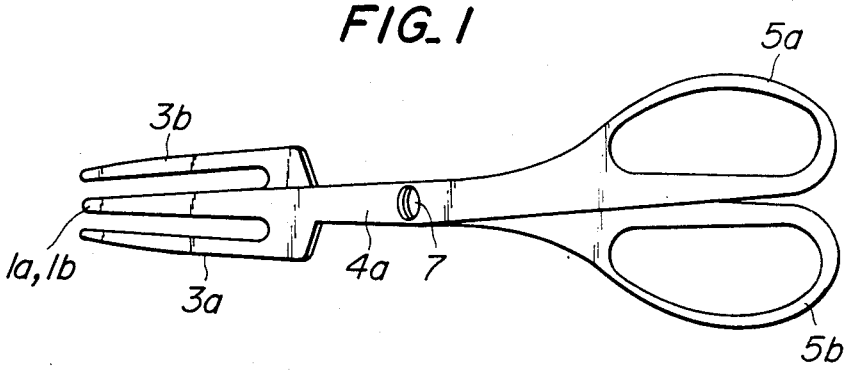
FIG. 1 is a plan view of Example 1 of the fork with the function of scissors and a plan view from the direction of arrow taken along lines 1—1 of FIG. 2.
Figure 2:
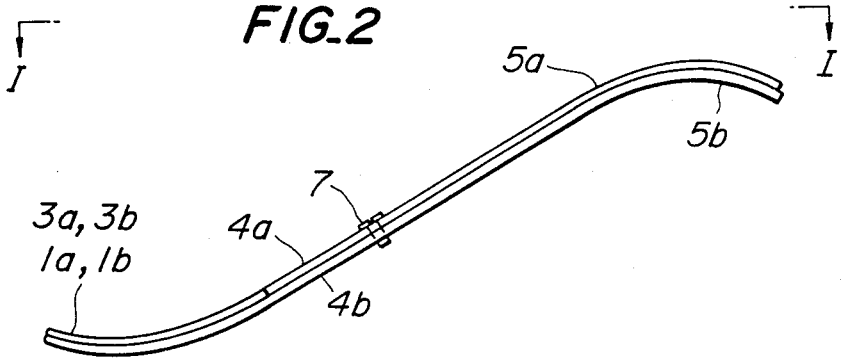
FIG. 2 is a side view of that fork.
Figure 3:
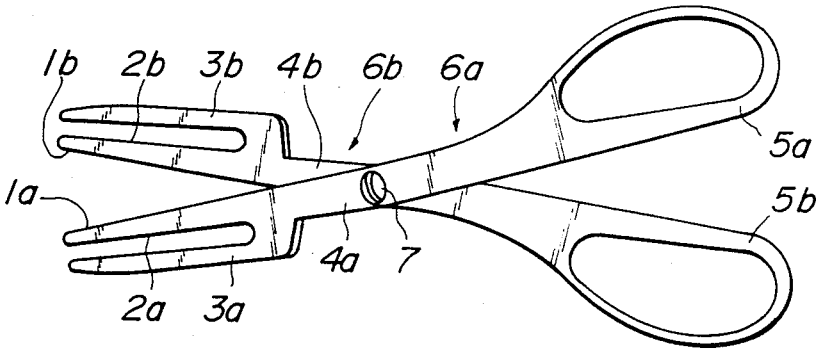
FIG. 3 is a plan view illustrating the state in which the tip portions of the blade bodies are opened.
Figure 4:
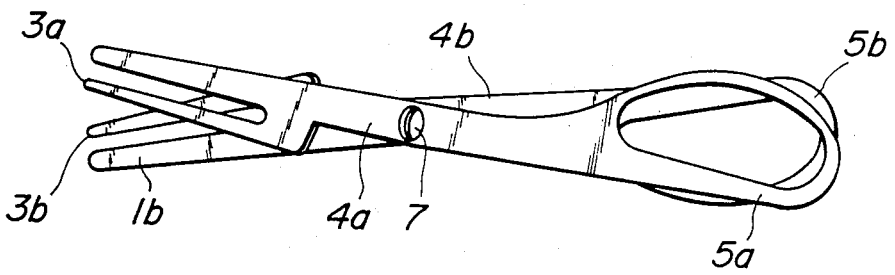
FIG. 4 is a plan view illustrating that the tool of the present invention becomes the smallest to be stowed.

The fork with the function of scissors will be explained about Example 1 by referring to FIGS. 1 through 5. 1*a* and 1*b* are the edges forming scissors and they curve as shown in FIG. 2. 2*a* and 2*b* are the back portions equivalent to the edges 1*a* and 1*b*. 3*a* 3*b* are the curving forks such as the edges 1*a* and 1*b* as shown in FIG. 2, diverging and separating from said back portions 2*a* and 2*b*, being set in parallel with the same back portions. The tip portion of the present tool consists of the edges 1*a* and 1*b* and the forks 3*a* and 3*b*. The edges 1*a* and 1*b* are similar to the united fork wherein two edges of scissors 1*a* and 1*b* are overlapped. This tip portion is similar to that of a usual fork for meals. 4*a* and 4*b* are the central portions wherein the axis of scissors 7 is fixed. 5*a* and 5*b* are the handle portions of scissors. Edge 1*a*, backportion 2*a*, fork 3*a*, central portion of scissors 4*a* and handle portion 5*a* form one blade body 6*a*. The other edge 1*b*, back portion 2*b*, fork 3*b*, central portion 4*b* and handle portion 5*b* from the other blade body 6*b*. As a result of pin-combination of the blade bodies 6*a* and 6*b* at the axis of scissors 7 in the central portions 4*a* and 4*b*, a system of scissors is formed. The formentioned scissor type of device is capable of one hand use for medical or kitchen application.

Figure 5:
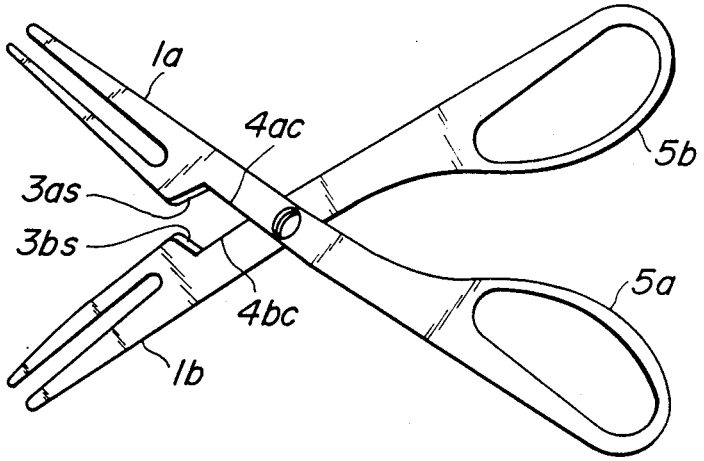
FIG. 5 is a plan view illustrating the position for special use of the edges.
Figure 6:
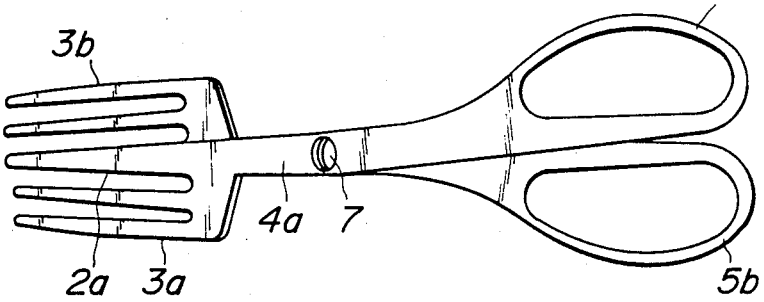
FIG. 6 is a plan view of Example 2.

In this tool for meals as illustrated in the side view of FIG. 2 the blade bodies 6*a* and 6*b* form a loose curve of letter S as a whole, curving against the plane central portions 4*a* 4*b*. Moreover in the blade bodies 6*a* and 6*b* the edge 1*a* and 1*b* overlap and the handle portions 5*a* and 5*b* do so because of the difference in turning plane at the axis 7. Consequently as illustrated in a plan view of FIG. 4 the present tool can be made the smallest on being stowed. As illustrated in FIG. 5, when the edge 1*a* crossing over the edge 1*b*, the sharp edges are fixed in the shoulder portions of the fork 3*as* and 3*bs* and in the central portions 4*ac* and 4*bc* around said shoulder portions, the solid foods such as crab's feet can be cut off easily if they are put in the space surrounded by said portions 3*as*, 3*bs*, 4*ac* and 4*bc*. As illustrated in FIG. 6 the tool for meals of Example 2 in which the forks 3*a* and 3*b* diverge two by two from each backportion 2*a* and 2*b* of two edges although the forks diverge one by one in Example 1.

Figure 7:
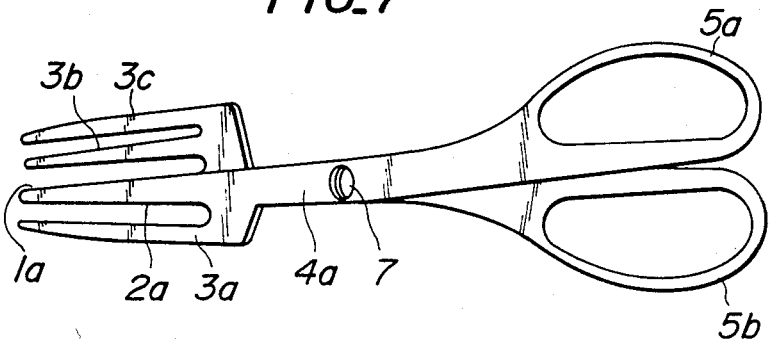
FIG. 7 is a plan view of Example 3.
Figure 8:
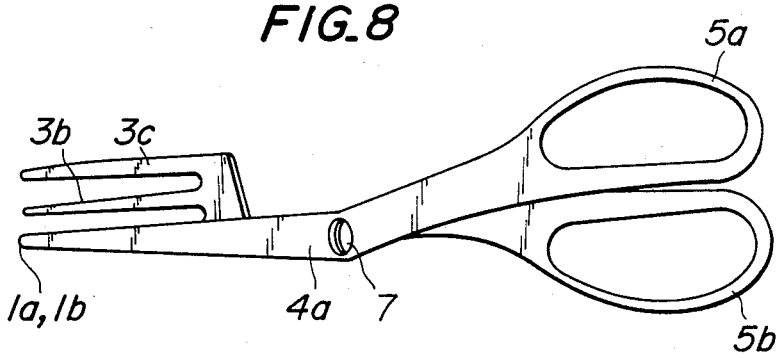
FIG. 8 is a plan view of Example 4.

As illustrated in FIG. 7 the tool for meals of Example 3 in which one fork diverges from the back portion of one edge in two edges and plural forks diverge from the back portion of the other edge. As illustrated in FIG. 8 the tool for meals of Example 4 in which one or plural forks diverge from the back portion of only one edge in two edges.

Figure 9:
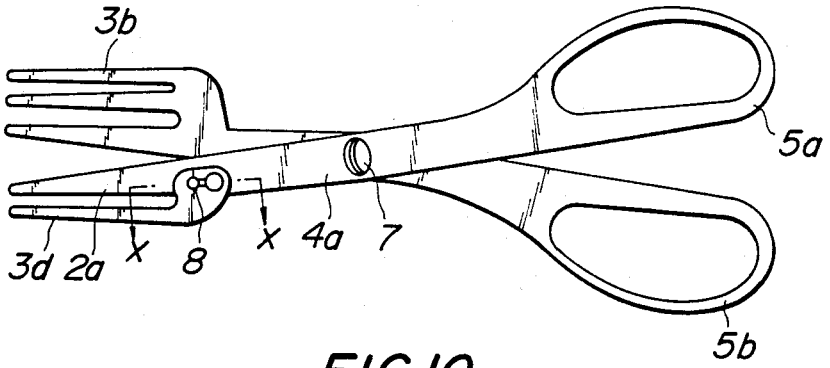
FIG. 9 is a plan view of Example 5.
Figure 10:
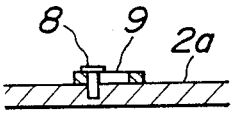
FIG. 10 is a sectional view taken along lines X—X of FIG. 9.

As illustrated in FIG. 9 the tool for meals of Example 5 in which the fork 3*d* fixed in the back portion of one edge can be fastened or unfastened freely in and from the back portion. FIG. 10 is a sectional view taken along lines X—X of FIG. 9. In FIGS. 9 and 10 a slender slit set in the root of the fork 3*d* is fixed in the projection 8 set vertically in the back portion 2*a* whose head similar to a plate. Then the fork 3*d* is fixed in the back portion 2*a* by making the fork 3*d* slide to the direction of the axis 7 of scissors.

Figure 11:
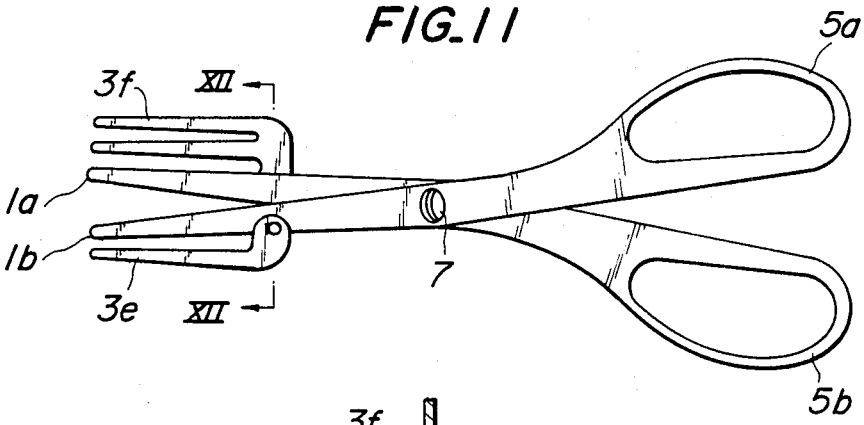
FIG. 11 is a plan view of Example 6.
Figure 12:
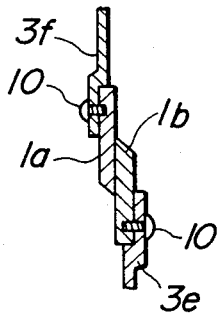
FIG. 12 is a sectional view taken along lines XII—XII of FIG. 11.
Figure 13:
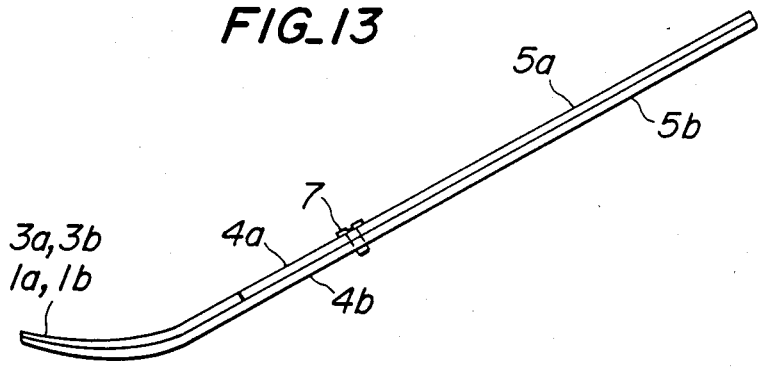
FIGS. 13 through 15 are each the side views of Examples 8 through 10.
Figure 14:
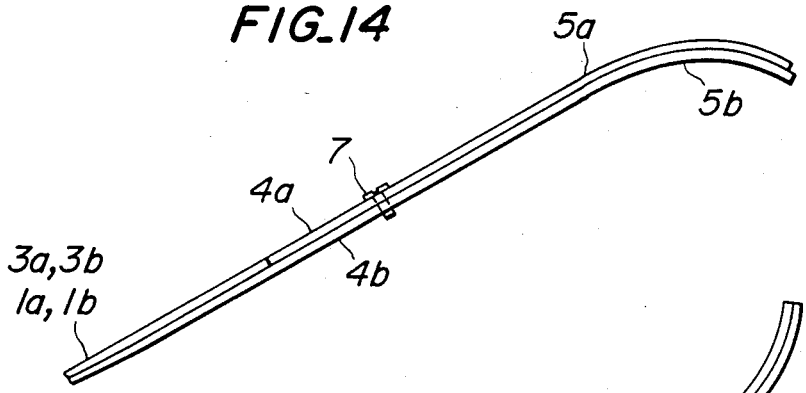
Figure 15:
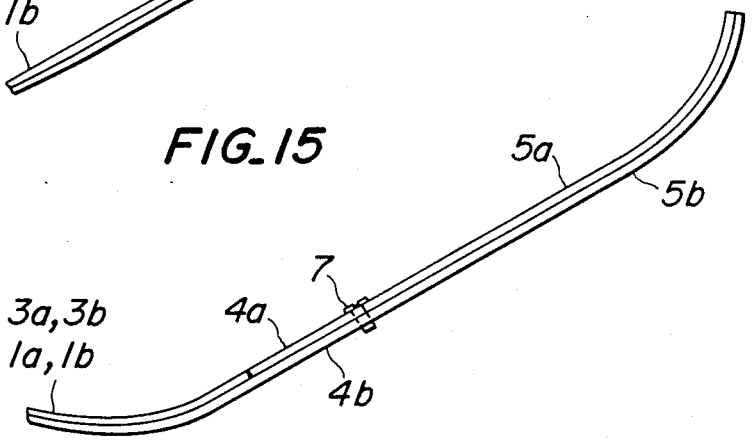
Figure 16:
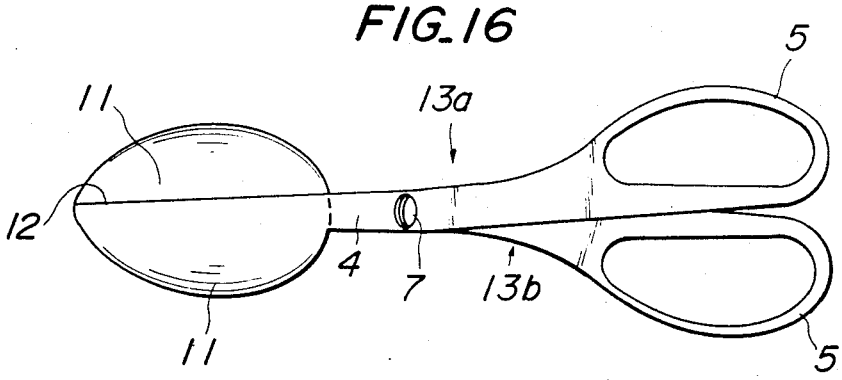
FIG. 16 is a plan view of Example 11 about the spoon with the function of scissors.
Figure 18:
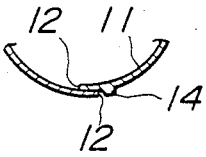
FIG. 18 is a sectional view taken along lines XVIII—XVIII of FIG. 17.
Figure 19:
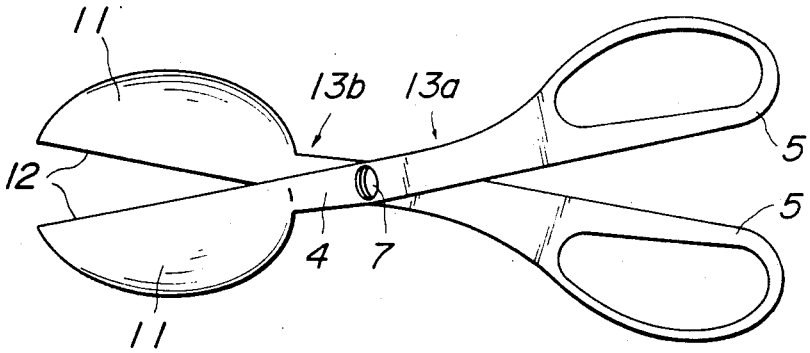
FIG. 19 is a plan view illustrating the state in which the tip portions of the edges are opened.

As illustrated in FIG. 11 the tool for meals of Example 6 in which the forks 3*e* and 3*f* can be fastened or unfastened freely in and from the back portion. FIG. 12 is a sectional view taken along lines XII—XII of FIG. 11. In FIGS. 11 and 12 the fork 3*e* and 3*f* are fixed in each back portion 1*b* and 1*a* by the screw 10. As illustrated in the side view of FIG. 2 the tool for meals of Example 7 in which the edge, the fork and the handle portion bend backward against the central portion of scissors 4*a* and form a loose curve of letter S as a whole. The number and arrangement of fork can be selected in various ways as described in the previous paragraphs. As illustrated in the side view of FIG. 13 the tool for meals of Example 8 in which the edge and the forks 1*a*, 1*b*, 3*a* and 3*b* curve and the handle portion 5*a* and 5*b* form almost a straight line against the central portion of scissors 4*a* from the side view. The number and arrangement of fork can be selected in various ways as described previously. As illustrated in the side view of FIG. 14 in the tool for meals of Example 9 the edge and the forks 1*a*, 1*b*, 3*a* and 3*b* form almost a straight line and the handle portions 5*a* and 5*b* curve against the central portion of scissors 4*a* from the side view. The number and arrangement of fork can be selected in various ways as described in preceding paragraphs. As illustrated in the side view of FIG. 15 in the tool for meals of Example 10 the edge, the fork and the handle portion curve against the central portion of scissors from the side view. Each one is only in one side of the plane which involves the central portion of scissors. The number and arrangement of fork can be selected in various ways as described previously. The spoon with the function of scissors will be explained about Example 11 by referring to FIGS. 16 through 19. 11 is the tip portion similar to one side of the sunken portion in the tip of the usual spoon for meals divided in two longitudinally. The edge of scissors 12 is put on in said divided border side. One blade body 13*a* is composed of said tip portion 11, the central portion of scissors 4 and the handle portion 5. The other blade body 13*b* has also the tip portion with an edge, the central portion and the handle portion. The blade bodies 13*a* and 13*b* are combined by pin at the axis of scissors 7 in the central portion 4 of each blade body and form a pair of scissors. As illustrated in FIG. 16 when two edges 12 overlap each other, the tip portion 11 becomes similar to the sunken portion of the tip of the spoon for meals. As illustrated in FIG. 19 when two edges 12 are opened, there can be seen one of the objects of the present invention, which is the function of scissors. Two blade bodies 13*a* and 13*b* are combined by pin at the axis 7. This combination can be also one-touched method applied to the scissors for medical anatomization and for kitchen works. As illustrated in the sectional view of FIG. 18 the projection 14 is set in the outside bottom of the tip portion 11 as a stopper of an interlocking last point in the edge of scissors 12. This projection 14 stops the leak of liquid in the spoon in contact with the edge 12. If said projection 14 by heat-resisting and synthetic resin is fixed in the position of said outside bottom in order to stop the injury of the edge 12 by the strong pressure between the edge 12 stopping the leak and the projection 14, said leak and the injury of the edge 12 can be stopped.

Figure 17:
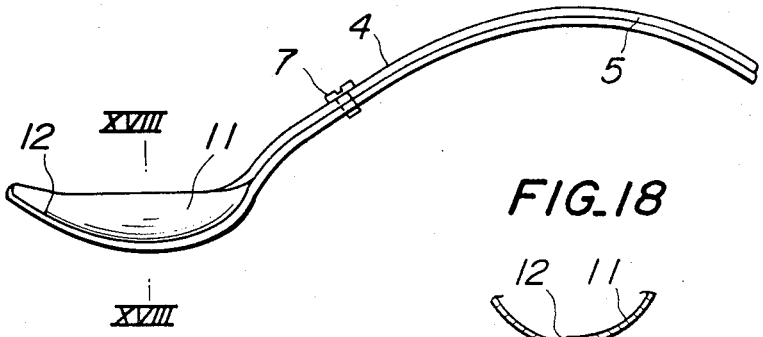
FIG. 17 is a side view of that spoon.

As illustrated in the side view of FIG. 17 in this tool for meals the edge 12 of the tip portion 11 and the handle portion 5 curve against the flat central portion 4 and form a loose curve of letter S as a whole.

Figure 20:
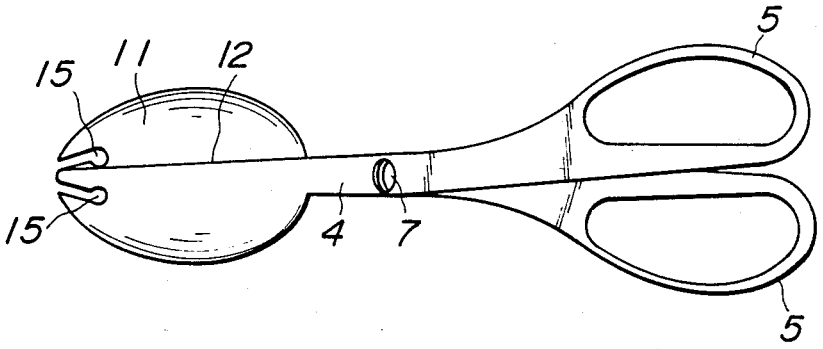
FIG. 20 is a plan view of Example 12.
Figure 21:
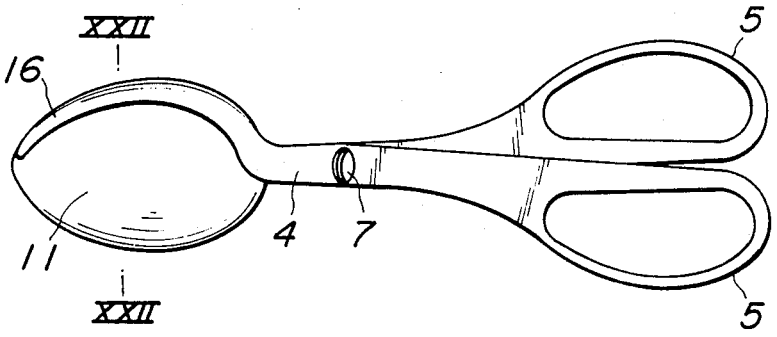
FIG. 21 is a plan view of Example 13.
Figure 22:
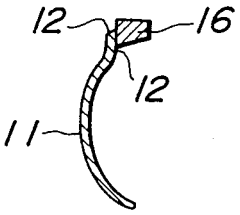
FIG. 22 is a sectional view taken along lines XXII—XXII of FIG. 21.

The tool for meals of Example 12 is as shown in FIG. 20. The original form of the tool for meals in the present example is used for meals of school boys and girls or for removing the seeds of watermelon. The tool for meals of the present example is an object wherein said original "spoon with divided tip" was improved according to Example 11. Because of narrow cuts 15 from the extreme end of the tip portion 11 toward the hands even if this tool is mainly used as a spoon with both tip portions closed, there is also the function of fork similar to the original "spoon with divided tip". Further as this tool for meals is used with tip portions being opened to some degree, it is convenient that both functions of fork and scissors can be seen and used. The tool for meals of Example 13 is as shown in FIG. 21. In the tool for meals of the present example, on dividing the sunken portion of the tip of the spoon longitudinally, it is not divided in the same shape and the tip portion 11 of the bigger portion is used as a spoon. The small portion 16 is similar to a thick sickle with an edge. The said spoon serves the function of holding food cut by movement of small portion 16. The function of scissors is the same as in other examples.

Figure 23:
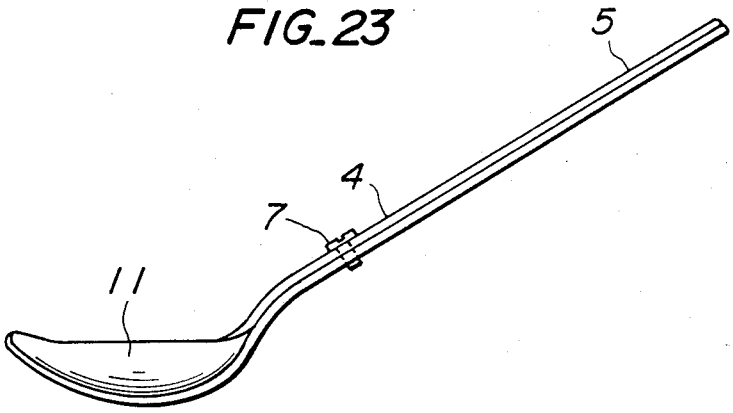
FIG. 23 and 24 are each the plan views of Examples 15 and 16.
Figure 24:
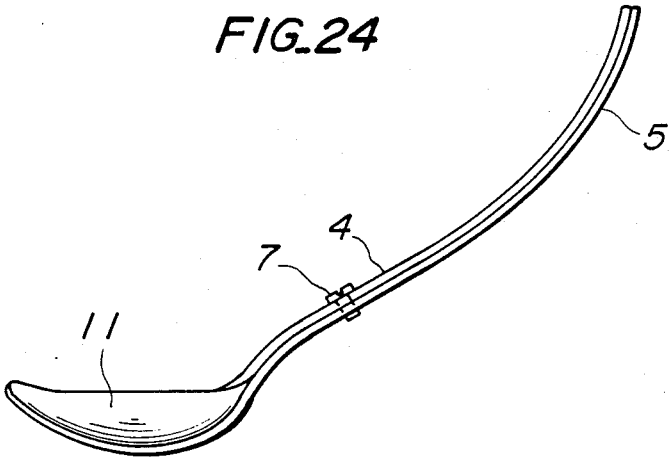

In examples 11 through 13 the relation among the tip, the central and the handle portion is not limited to a loose curve of letter S as shown in the side view of FIG. 17. As illustrated in the side view of FIG. 23 and 24 it is possible to make the handle portion 5 almost straight-lined or make it almost vertical in opposite direction against FIG. 17 on use. The shapes of said various handle portions can be decided according to the desires of the persons who use the present tool for meals.

The examples for use of the present tool for meals will be explained according to the kinds of foods.

(a) In case of boiled rice, either the fork or the spoon with the function of scissors of the present invention can be used with convenience.

(b) In case of juicy dishes, the big foods in juice are cut in right size in cup and can be eaten easily. It is convenient especially for elder people to cut foods in small pieces and eat them easily with the present tool at any time.

(c) In case of dishes, this tool is useful to stab, pinch and spoon dishes. For example, a cutlet, a beef steak and a fillet can be cut just as they are in plates without knife and fork. Any food can be carried to the user's mouth, being cut in small pieces according to their situations.

(d) Bean curds and boiled beans can be spooned by the tip portion of this tool in the same way as in a usual spoon or fork.

(e) In case of noodles and spaghetti, when they are linking between dish and mouth, they can be cut easily at any length by this tool for meals.

(f) Oranges can be easily peeled being cut in cross at the middle part of the skin by the tip of edge. The fruit bags of oranges can be eaten easily with a cut by the scissors.

(g) In addition to these examples for use the present tool for meals is also effective in other various cases like paring the skin of sausages and cutting off a shell ligament from its shell in cups and so forth.

As above mentioned, the tool for meals of the present invention makes it possible to cut, stab, pinch or spoon foods by only itself, and its handling can be easily done by only one hand. Five functions of chopsticks, knife, spoon, fork and scissors in Examples 11 through 13 are involved sufficiently in the present tool. Because of its handy shape, it is suitable not only for the meals in common homes, office restaurants, trains planes and school lunch feeding, but also for the meals in trip, hiking and calamity countermeasure. The present tool is also fitting for the meals of elder people and the handicapped.

I claim:

1. A tool for meals with the function of scissors, fork and crusher, comprising two blade bodies, each blade body being composed of:

(a) a tip portion, said tip portion having a sharp edge adapted to coact as a scissor portion, said tip portion having a fork set diverging and separating from a back portion of said sharp edge and in parallel with said back portion, said back portion being similar to a tip portion of the usual fork for meals by overlapping the sharp edges of said two blade bodies;

(b) a central portion, said central portion being pivotably connected by a pin to a central portion of the other blade body;

(c) a handle portion extending from said central portion;

(d) said central portion having a planar surface, said tip portion having a curvilinear plane curving in a predetermined direction from said planar surface, said handle portion having a curvilinear plane curving in an opposite direction with respect to said planar surface;

(e) said fork set having a shoulder integrally formed with said central portion, said shoulder and a portion of said central portion defining a dull edge, both of said shoulders and both of said portions of said central portion defining a crushing enclosure, whereby, when the handle portions are actuated to position the sharp edges opposing each other, a scissor action is obtained, and when the handle portions are pivoted over each other, the dull edges are positioned opposite each other, crushing action is obtained.

* * * * *